United States Patent [19]

Clawson et al.

[11] Patent Number: 4,669,199

[45] Date of Patent: Jun. 2, 1987

[54] CLOTHES DRYER WITH A LINT INCINERATOR

[75] Inventors: Lawrence G. Clawson, Dover; Wesley W. Teich, Wayland, both of Mass.

[73] Assignee: Raytheon Company, Lexington, Mass.

[21] Appl. No.: 846,412

[22] Filed: Mar. 31, 1986

[51] Int. Cl.[4] ..... F26B 21/06

[52] U.S. Cl. ..... 34/82; 34/85; 34/133

[58] Field of Search ..... 34/23, 35, 82, 85, 86, 34/77, 126, 131, 133; 432/112, 113, 105

[56] References Cited

U.S. PATENT DOCUMENTS

| | | | |
|---|---|---|---|
| 2,809,025 | 10/1957 | Pettyjohn | 263/33 |
| 3,121,000 | 2/1964 | Hubbard | 34/133 |
| 3,132,006 | 5/1964 | Brucken | 34/82 |
| 3,306,596 | 2/1967 | Hollowell | 263/10 |
| 4,557,058 | 12/1985 | Ozawa et al. | 34/82 |

*Primary Examiner*—Albert J. Makay
*Assistant Examiner*—David W. Westphal
*Attorney, Agent, or Firm*—William R. Clark; Richard M. Sharkansky

[57] ABSTRACT

A dryer having a cylindrical lint screen connected to and extending from the rear of a rotating clothes drum. The drum is defined by a circumferential wall having perforations or air exit ports. A casing surrounds the drum thereby defining an air recirculation passageway from the perforations radially through the screen. Airborne lint is deposited on the screen as air passes therethrough en route to either the drum air inlet or the exhaust outlet. The lint is incinerated as the screen rotates past the drying air heat source.

28 Claims, 8 Drawing Figures

CLOTHES DRYER WITH A LINT INCINERATOR

BACKGROUND OF THE INVENTION

This invention relates generally to lint removal systems for clothes dryers. In a conventional dryer, heated air is forced through a rotating drum for evaporating moisture from damp clothes tumbling therein. Air expelled from the drum carries away moisture in addition to lint particles imparted from the clothes. The expelled air is channeled through a duct which is adapted to provide an operator accessible location for a lint filter or screen disposed within the expelled air stream. Airborne lint is accumulated upon the screen during the drying cycle which requires periodic removal.

The manual lint removal required by the above approach may be burdensome, particularly in a commercial setting such as a self-service laundry. Further, degradation of dryer performance occurs during the drying cycle as lint accumulation progressively impedes expelled air flow.

A number of approaches have been attempted to remove lint automatically thereby eliminating the need for manual removal. Various systems have been proposed wherein lint is accumulated in the discharge duct by screen filters, or centrifugal separators, and then incinerated by a separate heat source. By requiring a separate heat source, in addition to the heat source for heating drying air, the overall efficiency of these systems is impaired.

In another approach, U.S. Pat. No. 2,809,025 discloses the incineration of lint by diverting hot gases from the dryer burner through a bypass tube into the discharge duct. A rotating screen collects lint within the duct, the lint being combusted as the screen rotates past the bypass tube. This approach has several disadvantages. First, hot gases, which otherwise would be utilized for drying clothes, are diverted directly into the exhaust duct. Second, the combustion gases are cooled as they travel throuch the bypass tube. Hence, lint combustion may produce unacceptable levels of ash and carbon residues.

An approach wherein lint is incinerated directly by the dryer burner is shown in U.S. Pat. No. 3,306,596. Air expelled from the drum is channeled through an outlet duct to an outside flue. A portion of the outlet duct is positioned adjacent to the burner area thereby enabling a rotating disc or lint filter to communicate between the duct and burner area. Expelled air passes axially through the disc depositing lint thereon which is combusted as the disc rotates through the burner area. This approach has significant disadvantages. First, the rotating disc assembly requires additional drive components. Second, if the disc fails to properly rotate the expelled air flow will be impeded resulting in degradation of performance and a possible fire hazard.

An additional problem with all of the prior approaches to lint removal is that the ducting required for placement of lint filters, or the placement of lint incineration devices, has added to the size, complexity and thermal mass of the dryer.

SUMMARY OF THE INVENTION

These and other objects and advantages are provided by the invention which defines a clothes dryer, comprising a clothes drum, a cylindrical lint filter connected to the drum and extending axially from one end thereof, means coupled to the drum for axially rotating the drum whereby the filter is also rotated, means for moving air out of the drum and radially through the filter, the air carrying lint from the clothes which is deposited on the screen, and stationary burning means adjacently positioned to the filter for burning lint on the filter as the lint filter rotates past the stationary burning means. It may be preferable for the stationary burning means to comprise a gas burner wherein the burner flames are directed against the filter. Preferably, the filter may comprise a metal screen or mesh.

The invention futher defines a clothes dryer, comprising a clothes drum having a backwall or backend and a circumferential wall with perforations, the drum also having an air inlet in the backwall, a housing spatially separated from and encapsulating both the drum backwall and the drum circumferential wall, an exhaust outlet connected to the housing opposite the drum backwall, a cylindrical filter attached to the drum, the filter extending axially from the backwall to the housing thereby encircling the exhaust outlet, all air entering the exhaust must therefore first pass through the filter, a motor connected to the drum for rotating the drum and the filter, therefore, the filter is rotated without the need for separate drive components, an air passageway defined by the spacing between the housing and both the circumferential wall and the backwall, thus the need for recirculation ducts and for exhaust ducts is eliminated, a fan coupled to the drum air inlet for forcing air into the drum and expelling the air through the perforations, the fan drawing the expelled air from the perforations back through the air passageway and radially inward through the filter, the air carrying lint from the clothes which is entrapped in the filter, the fan also drawing a portion of the expelled air into the drum air inlet after the expelled air has passed through the filter, means for drawing the remaining portion of the expelled air through the exhaust outlet after the expelled air has passed through the filter, and a burner positioned adjacent to the filter for heating air entering the drum air inlet, the burner also incinerating the lint as said filter rotates past the burner.

BRIEF DESCRIPTION OF THE DRAWINGS

The foregoing and other objects and advantages of the invention will be more readily understood by reading the Description of the Preferred Embodiment with reference to the Drawings wherein.

DESCRIPTION OF THE PREFERRED EMBODIMENT

Figure 1:
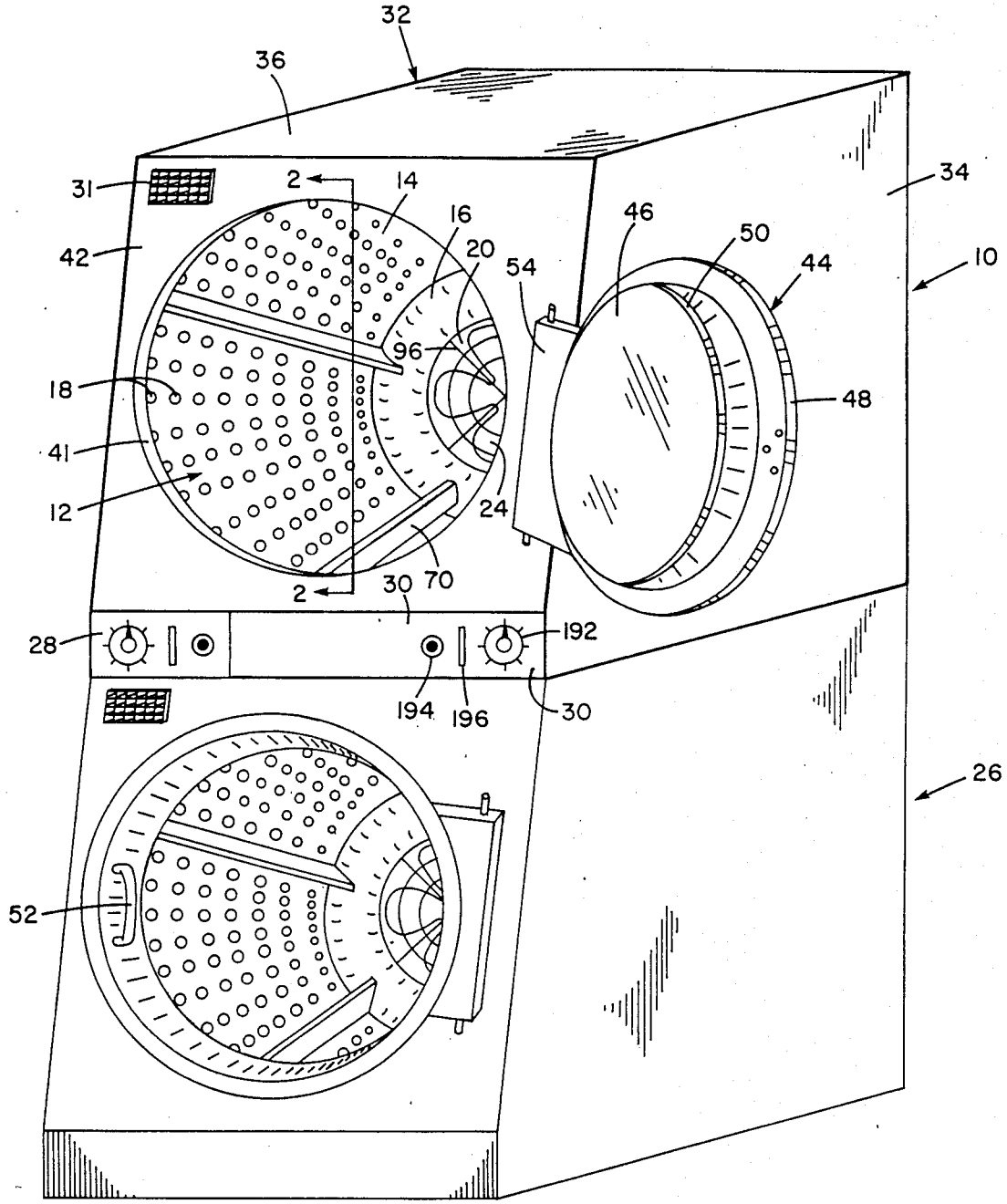
FIG. 1 is a perspective view of dryer 10 shown mounted on top of a similar dryer 26.
Figure 2:
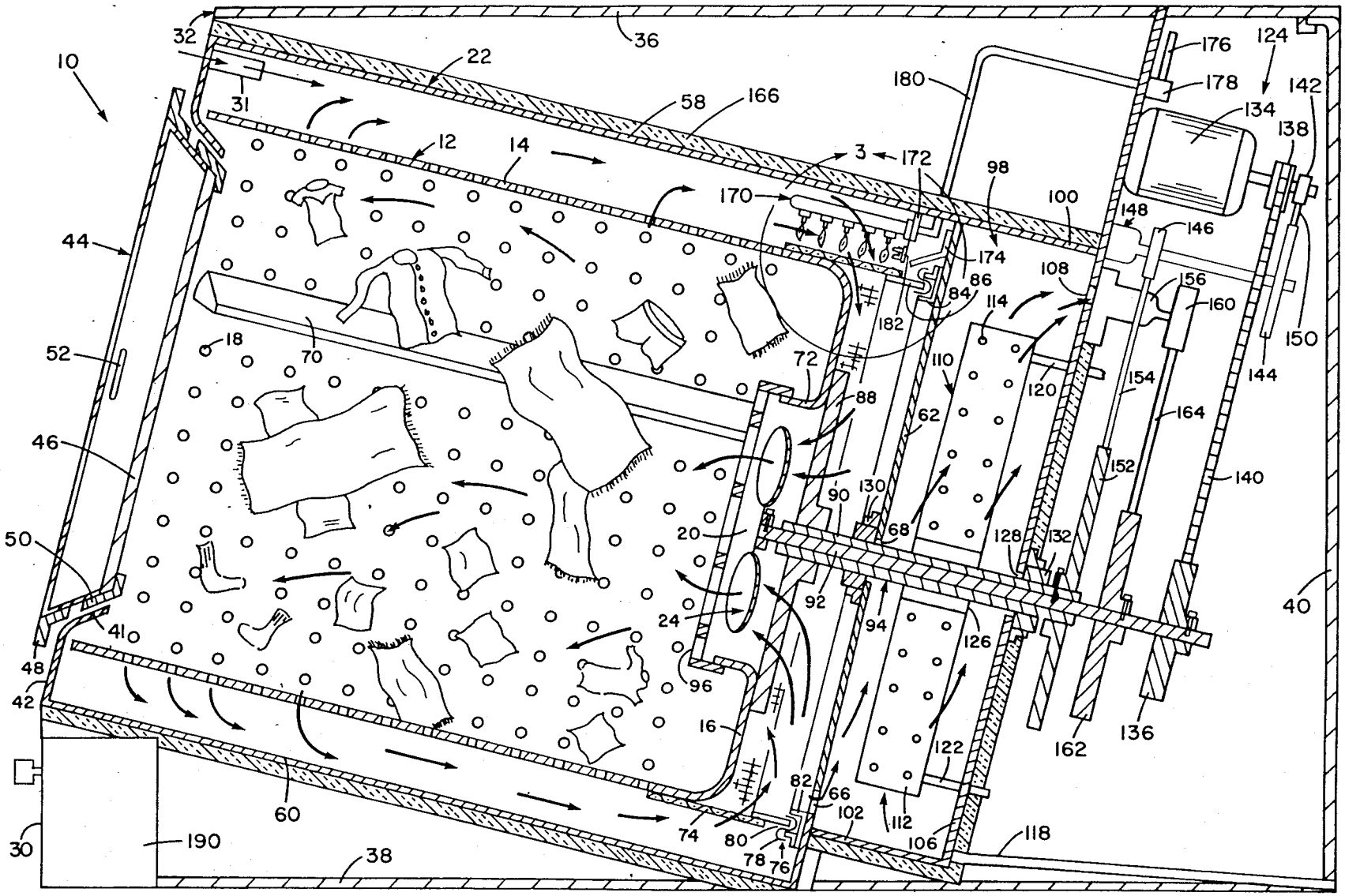
FIG. 2 is a sectional view of dryer 10 taken along line 2—2 of FIG. 1.

Referring to FIGS. 1 and 2, a commercial dryer 10 is illustrated. Dryer 10 broadly comprises rotating clothes drum 12 having circumferential wall 14 and drum backwall 16. Circumferential wall 14 includes drum exit ports or perforations 18. Backwall 16 includes drum air inlet 20. Substantially air tight casing or drying compartment 22 surrounds walls 14 and 16 of drum 12. Cylindrical filter or screen 74 is attached to circumferential wall 14 and extends axially from backwall 16 to casing 22. Motor 134 is coupled to drum 12 thereby rotating both drum 12 and screen 74. Burner 170, shown positioned over screen 74 within casing 22, fires radially through screen 74 towards drum air inlet 20. Axial fan 24 or other air moving means is coupled to the drum air inlet 20 for moving air into drum 12, across the clothes tumbling therein and expelling the air radially out through perforations 18. Fan 24 also draws the expelled air from perforations 18 longitudinally back between circumferential wall 14 and casing 22 and radially through screen 74. The air drawn through screen 74 carries lint from the clothes which is deposited on screen 74. As described in greater detail hereinafter, the deposited lint is incinerated as screen 74 rotates past burner 170.

Continuing with FIG. 1, dryer 10 is shown stacked on top of a similar dryer 26. For reasons described hereinafter, dryer 10 is sufficiently compact to enable stacking a pair of dryers in approximately the same space required for a single conventional dryer. Dryer 26 is of nearly identical construction to dryer 10 except that control panel 30 of dryer 10 thereby elevating control panel 28 above ground level for operator convenience.

Dryer 10 includes an outer cabinet 32 having side walls 34, ceiling 36, frontwall 42, bottom 38 (FIG. 2) and backwall 40 (FIG. 2). Frontwall 42 includes circular flange 41 around circular opening 43 (FIG. 2). Control panel 30 and air inlet 31 are coupled to frontwall 42. Door 44 having recessed glass panel 46, outer seal 48, inner seal 50 and handle 52 is attached to front wall 42 by a conventional hinge assembly 54. Outer seal 48 and inner seal 50 provide a substantially air tight seal against front wall 42 and flange 41, respectively, when door 44 is in the closed position.

Shown mounted on control panel 30 are operator actuable controls including timer 192, start button 194 and coin entry slot 196. These controls are coupled to controller 190 which is located behind control panel 30 as illustrated in FIG. 2. Controller 190 controls various dryer 10 components throughout the drying cycle including ceramic igniter tip 182, gas valve 178 and motor 134. Controller 190 is also coupled to temperature sensor 198 (not shown), preferably a thermistor, to maintain constant drum air inlet temperature by thermostatically controlling burner 170 in a conventional manner. Other conventional dryer components and operator actuable controls may be coupled to controller 190 such as, for example, temperature selections, fabric selections and safety interlocks. These components, however, are not illustrated or described herein since they are well known in the art and not necessary for an understanding of the invention.

A more detailed description of dryer 10 is now given. Referring back to FIG. 2, open rectangular drying compartment or casing 22 is shown having top wall 58, bottom wall 60, backwall 62 and side walls 64 (FIG. 5) spatially separated for encapsulating drum 12. Backwall 62 includes exhaust outlet 66 and shaft opening 68. Walls 58, 60 and 64 are welded or attached in a substantially air tight manner to frontwall 42 of cabinet 32. Accordingly, casing 22 communicates with inlet air vent 31, door 44 and exhaust outlet 66.

Drum 12 is concentrically positioned within casing 22 in a cantilevered fashion by the interconnection of drum 12, radial beam 88 and axial drum shaft 90 of drive shaft 94. Axial fan 24 is positioned within drum air inlet 20 and connected to fan shaft 92 of drive shaft 94. Drum air inlet 20 is surrounded by baffle 72 having fan guard 96 attached thereto to prevent the intrusion of clothing against fan 24. Three axial ribs 70, spaced 120° apart, are connected to the interior of drum 12 for tumbling the clothing in a conventional manner. To enhance the tumbling of clothing, both drum 12 and casing 22 are positioned within cabinet 32 at a downward inclination such as, for example, 10°

Cylindrical lint filter or screen 74, preferably constructed of a meshed material able to withstand high temperatures without distortion such as, for example, stainless steel is attached to circumferential wall 14 and extends outwardly from drum 12 towards back wall 62 of drying compartment 22. As may be seen more clearly in FIG. 3, circular seal 76 is attached to compartment backwall 62 and coaxially aligned with screen 74. Seal 76 is defined by grooved ring 78, preferably constructed of a pliable heat resistant material having low sliding frictional losses such as synthetic resin polymer, fitted into a circular channel 80 between inner concentric ring 82 and outer concentric ring 84. Cylinder extension 86, preferably constructed from teflon, is attached to screen 74 and extends therefrom into grooved ring 78 of seal 76. Exhaust outlet 66 is connected to compartment backwall 62 within the perimeter of seal 76. Accordingly, all the air entering drum air inlet 20 and all the air entering exhaust outlet 66 must pass through screen 74. Further, screen 74 is free to rotate within seal 76 as drum 12 rotates.

A conventional atmospheric gas burner 170 is positioned over screen 74 and attached to top wall 58 of compartment 22 by assembly 172. Shield 174 is positioned between burner 170 and seal 76 to prevent high temperature distortion of the teflon materials. Burner 170 is connected to gas inlet pipe 176 by the series interconnection of electronically controlled gas valve 178 and pipe 180. Ceramic igniter tip 182 which is adjacently positioned to burner 170 on assembly 174 and gas valve 178 are connected (not shown) to control circuitry 190.

Figure 6:
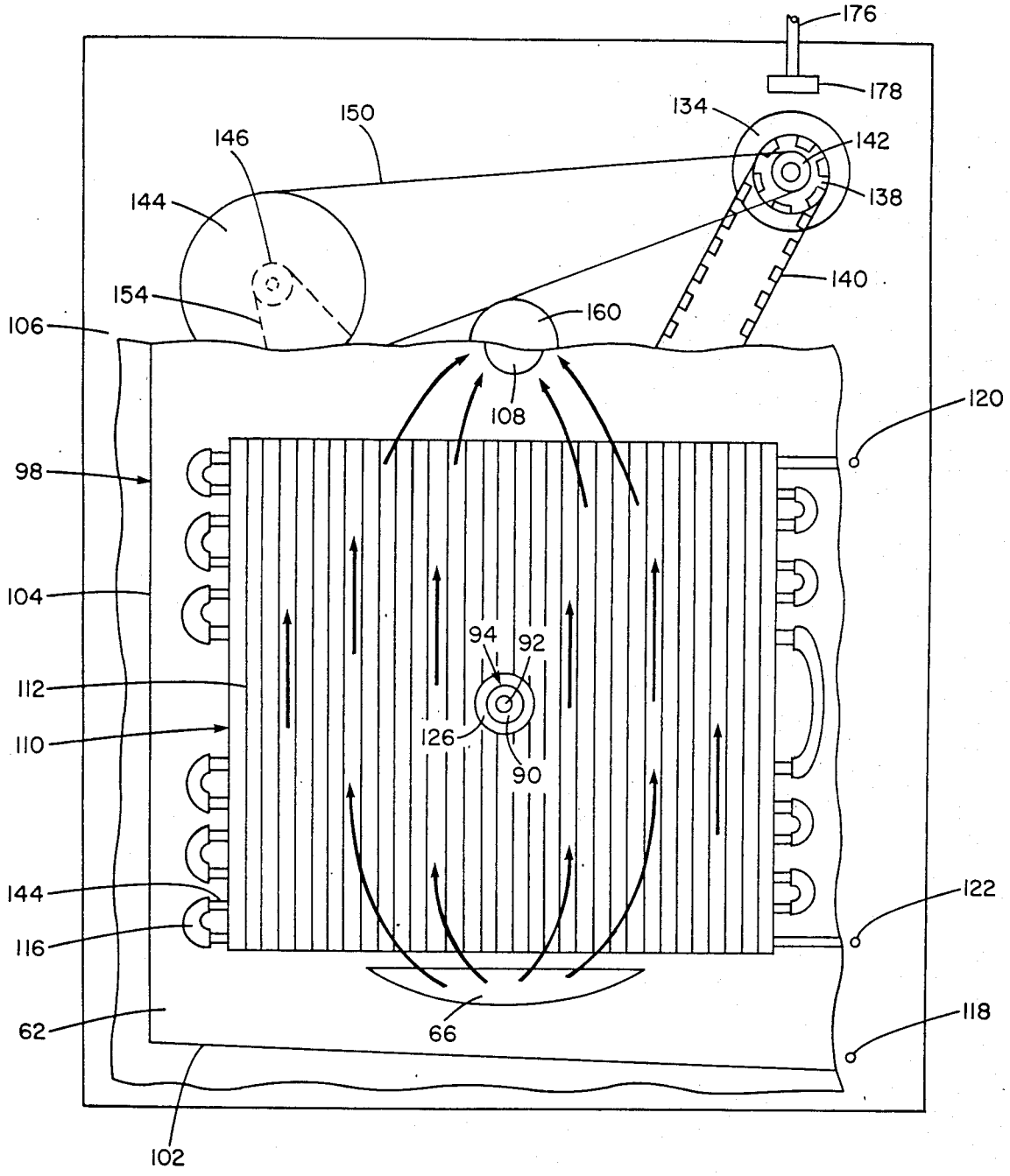
FIG. 6 is a view of FIG. 4 with a portion of rear wall 106 of exhaust air compartment 98 partially broken away to show heat exchanger 110.

Continuing with FIG. 2, and also referring to FIG. 6, exhaust air compartment 98 having top wall 100, bottom wall 102, side walls 104 (FIG. 6) and backwall 106 is shown. Walls 100, 102 and 104 are welded or connected in a substantially air tight manner to backwall 62 of drying compartment 22. Exhaust outlet 66 in backwall 62 and flue outlet 108 in backwall 106 of compartment 98 enable exhaust air from casing 22 to upwardly flow through compartment 98.

A condensing heat exchanger 110 having vertical fins 112 connected in heat transfer relationship with horizontal tubes 114 is vertically positioned within exhaust compartment 98. Tubes 114 are interconnected in series by elbows 116 (FIG. 6) to form a downward zig zag flow path between cold water inlet 120 and hot water outlet 122.

The spacing between backwall 106 of exhaust compartment 98 and backwall 40 of cabinet 32 defines motor compartment 124. Drive shaft 94 extends from shaft opening 128 in backwall 106, through shaft opening 126 in heat exchanger 110, through shaft opening 68 in compartment 22 and into drum air inlet 20. Bearing 130 and bearing 132 are respectively positioned over shaft openings 68 and 128 for supporting drive shaft 94 and sealing the shaft openings from air leakage. Drive shaft 94 includes outer drum shaft 90 and inner fan shaft 92 separated by conventional means such as bearings (not shown).

Figure 4:
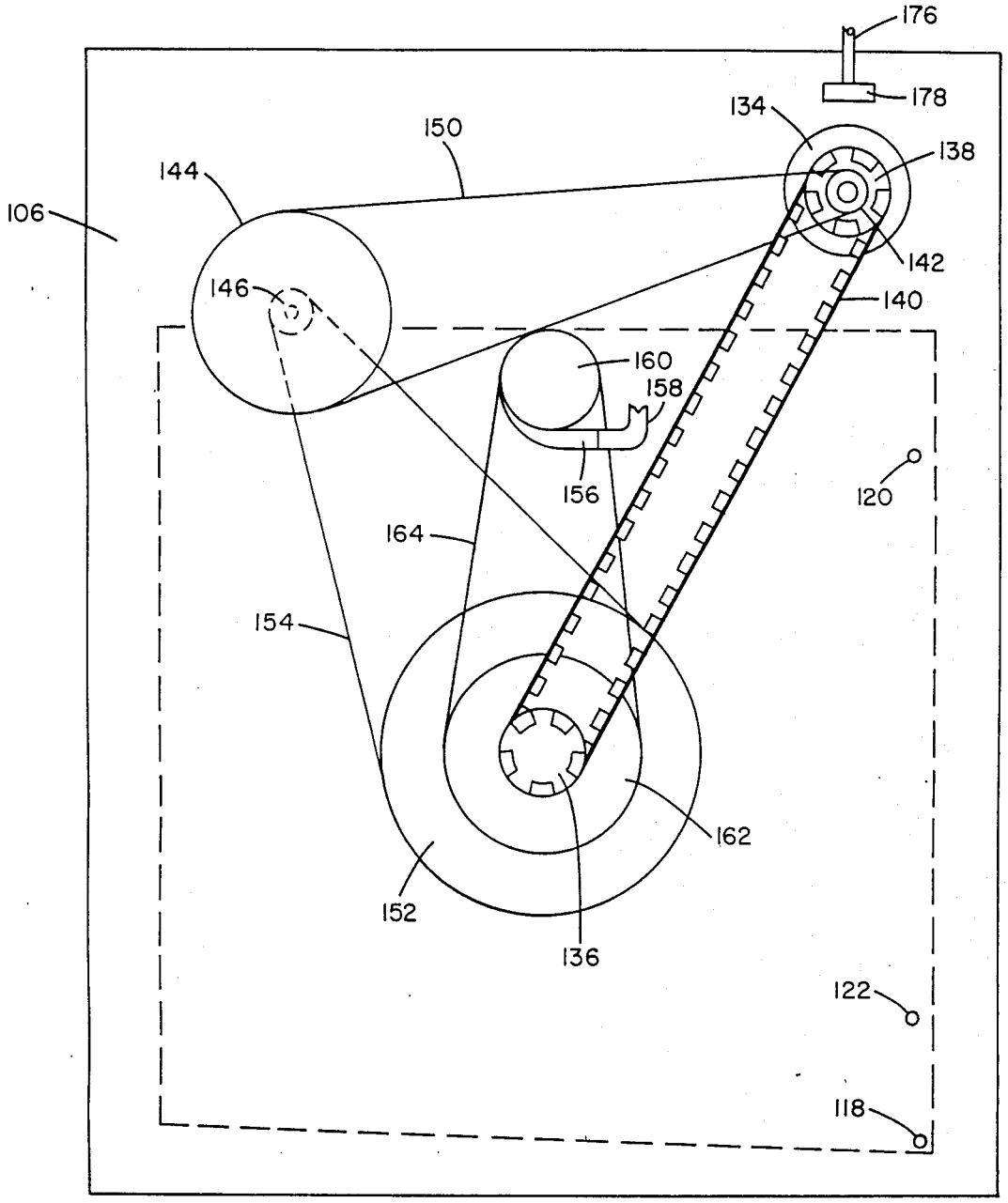
FIG. 4 is a rear elevation view of dryer 10 with rear panel 40 removed and looking into drive shaft 94 which is axially aligned with drum 12.

Referring to FIG. 4, and continuing with FIG. 2, fan shaft 92 is coupled to variable speed electric motor 134 by means of fan shaft sprocket 136, motor sprocket 138 and interconnecting chain 140. Drum 12 is coupled to electric motor 134 by beam 88, drum shaft 90, drum shaft pulley 152, interconnecting belt 154, inner pulley 146 and outer pulley 144 of reduction assembly 148, interconnecting belt 150 and motor pulley 142. Exhaust blower 156 is coupled to electric motor 134 by blower pulley 160, fan shaft pulley 162 and interconnecting belt 164. Blower 156 is connected to flue outlet 108 of exhaust compartment 98 for drawing exhaust air therefrom.

The aforementioned pulleys and sprockets have diameters selected in a conventional manner to achieve the desired air flows for fan 24 and blower 156, and the desired rotation for drum 12.

Figure 5:
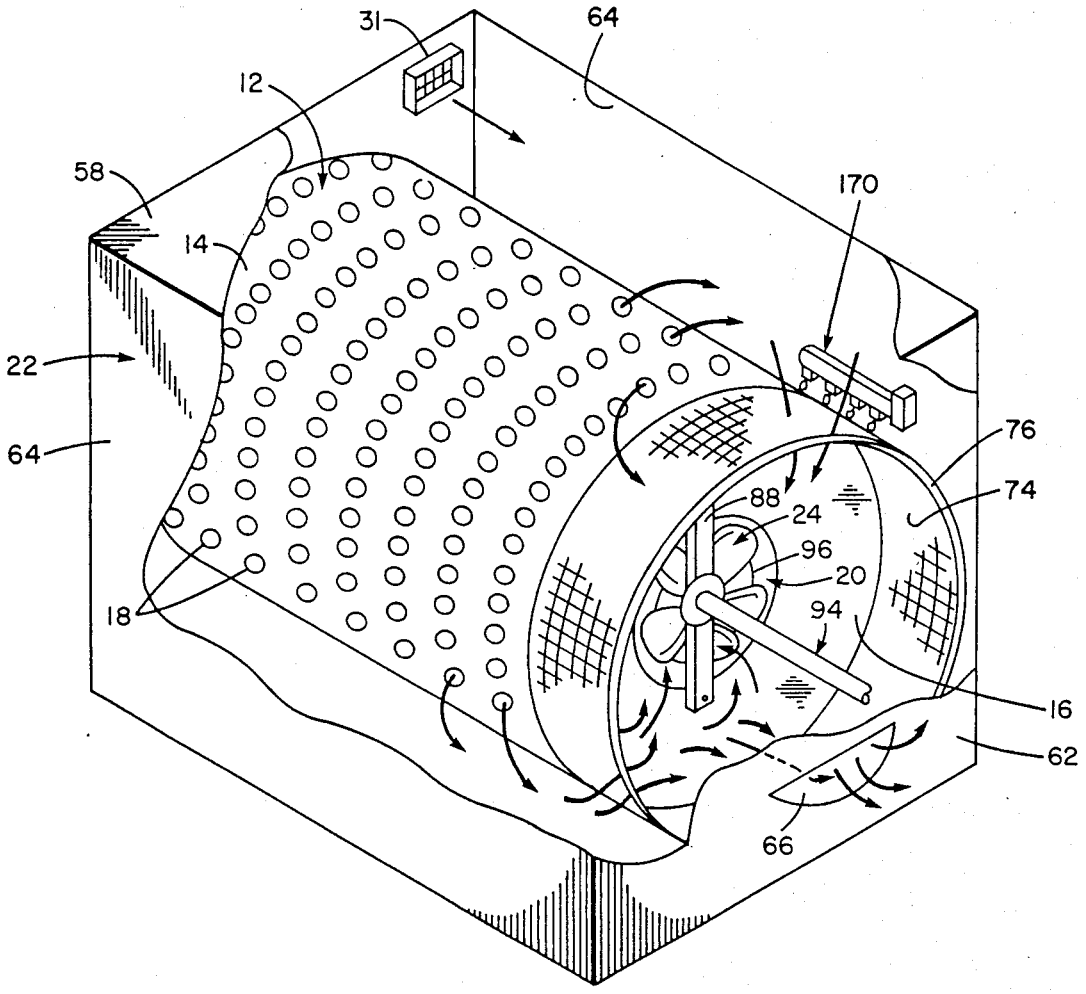
FIG. 5 is an isometric view of casing 22 shown partially broken away to show drum 12 and lint screen 74.

In accordance with the above description, and referring to FIGS. 2 and 5, the operation of dryer 10 is now described. The parameters described herein with respect to air flows, drum rotation and temperature are meant to be illustrative only and not limiting. Those skilled in the art will recognize that the invention described herein may be used o to advantage with a wide range of parameters.

Upon operator insertion of the proper coinage into coin entry slot 196, actuation of timer 192 and start button 194 on control panel 130 (FIG. 1), control circuitry 190 sequentially activates ingiter 182, gas valve 178 and motor 134 in a conventional manner well known by those skilled in the art. Burner 170, which is thermostatically controlled by control circuitry 190, fires radially into screen 74 to maintain drum air inlet temperatures of approximately 200° F. Approximately 1500 cfm of the heated air is forced by fan 24 into drum 12 and over the clothes tumbling therein. The air flowing across the clothes, which is at approximately twice the flow of conventional dryers, carrys away moisture and lint from the clothes as the air is radially expelled from drum 12 through all perforations 18. To maintain a relatively low exit velocity of approximately 6 fps through perforations 18, it is necessary that substantially the entire surface area of circumferential wall 14 be perforated. Thus, the total cross-sectional area through which the air is expelled is maximized thereby maintaining conventional exit velocities with double the air flow through the dryer. Otherwise, the air forced into drum 12 would result in sufficiently high exit velocities to impel the clothes against drum 12 thereby impeding the flow of air through drum 12 and also impeding the tumbling of clothes within drum 12.

Fan 24 also draws the expelled air from perforations 18 longitudinally back between circumferential wall 14 and compartment 22, and radially through screen 74. Lint carried by the expelled air is deposited on screen 74 as the air passes therethrough. Concurrently, exhaust blower 156 draws approximately 100 cfm of the expelled air passing through screen 74 into exhaust outlet 66. Thus, the remaining 1400 cfm of expelled air will be recirculated back into drum inlet 20 by fan 24. In addition, fan 24 draws approximately 100 cfm of replacement or ambient air from air inlet vent 31 longitudinally back between circumferential wall 14 and compartment 22, and radiallv through screen 74 into drum air inlet 20. The mixture of ambient air and recirculated air is heated to by burner 170 before being drawn through drum air inlet 20 by fan 24. A drum inlet air temperature of approximately 200° F. is maintained to maximize the capacity of air to hold water vapor while avoiding fabric damage to the clothes as they dry out.

It follows from the foregoing that over 90% of the air entering drum 12 is recirculated air. This high percentage of recirculation over damp clothes results in exhaust air having a dew point of 135° F. when steady state temperatures are reached. On the other hand, the dew point would only be between 90° F.–100° F. if a conventional 50% air recirculation was utilized. Consequently, the latent heat of vaporization which may potentially be recovered from the water vapor content of a given mass of exhaust air is increased approximately fourfold by increasing the percentage of recirculation to over 90%. This is especially important considering the low exhaust temperatures of clothes dryers. More specifically, at an exhaust temperature of 167° F. and dew point of 135° F., the enthalpy or BTU per pound of exhaust air which may potentially be recoverd from latent heat of vaporization is 139 BTU/lb. The enthalpy which may be recovered from sensible heat (mc $\Delta T$) is only 40 BTU/lb. Thus, high recirculation results in dramatically higher total exhaust enthalpy which may be used to advantage. For example, the high enthalpy output exhaust may be used to heat water to high temperature in heat exchanger 110 as described hereinafter.

Even though high recirculation has substantially increased the water vapor content of recirculated air, drying time has not been impaired due to the high volume of air forced through drum 12. In addition, the increase in air flow does not require a proportional increase in burner input to maintain constant air inlet temperature due to the high recirculation. With the drum inlet air composed of a mixture of 93% recirculated air at 167° F. and 7% ambient air at 70° F., a $\Delta T$ of less than 40° F. is required to raise the mixture to 200° F. Whereas, the $\Delta T$ required at 50% recirculation is over 80° F.

Dryer 12 also provides the advantage of more evenly heated inlet air. By raising the mixture of recirculated air and ambient air a relatively low $\Delta T$, the likelihood of hot spots or overheated air which may cause fabric damage is substantially reduced.

Another advantage obtained by dryer 12 is that the thermal mass has been minimized. The manner in which air is recirculated directly around drum 12 has eliminated the need for exhaust ducts and recirculation ducts. Further, burner 170 fires directly into the mixture of ambient air and recirculation air thereby eliminating the need for a separate burner box or heating chamber. Heat which would otherwise be wasted in heating thermal mass is utilized to evaporate moisture thereby increasing drying efficiency and shortening drying time.

The transfer of heat from exhaust air to water by condensing heat exchanger 110 is now described with particular reference to FIGS. 2 and 6. Blower 176 draws approximately 100 cfm of exhaust air over heat exchanger fins 112 in a parallel direction thereto. During steady state or second stage drying, as explained in greater detail hereinafter, the exhaust air is at an approximate temperature of 167° F. and a dew point of 135° F. The heat exchanger surface area and flow of water through tubes 114 at approximately 1½ gpm are matched to cool exhaust air to approximately 80° F. Both sensible heat and heat of condensation are thereby transferred from the exhaust air to the water heating the water to approximately 125° F.–130° F. Water at this high temperature is suitable for direct use in washing machines. On the other hand, if the exhaust air dew point was a conventional 90° F.–100° F., water could only be preheated to 80° F.–90° F. which is not suitable for end use.

Figure 7A:
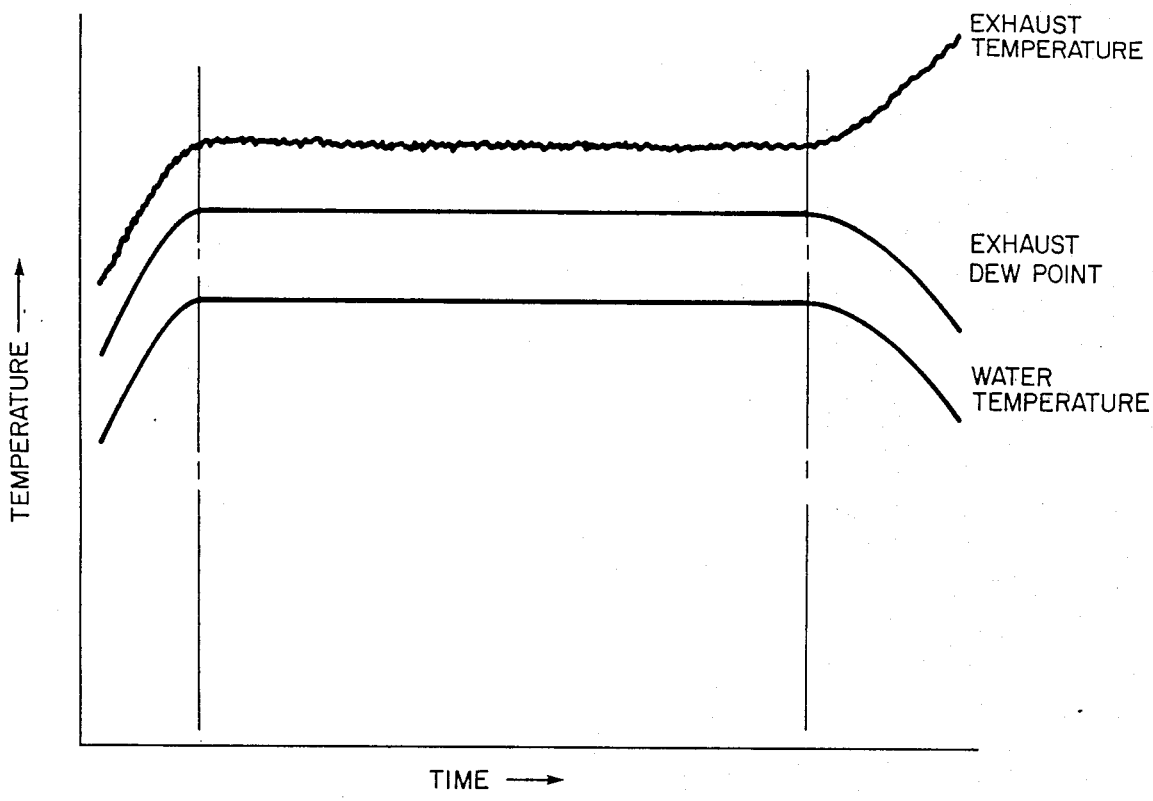
FIG. 7A is a graph of temperature versus time for exhaust air temperature, exhaust air dew point and water temperature.

Water at 125° F.–130° F., however, is only available when steady state exhaust temperatures are reached. This is illustrated by the graph of FIG. 7A wherein exhaust air temperature, exhaust air dew point and output water temperature are plotted against drying time for a constant inlet air temperature. The graph illustrates three drying stages. During the first stage, exhaust air temperature and dew point rise rapidly as the thermal mass of compartment 22, drum 12 and the clothes therein achieve steady state temperature. The second stage illustrates relatively constant temperature and dew point as heat input, less peripheral losses, matches evaporation in the wet clothes. Consequently, this stage is characterized by maximum water removal from the clothes at a relatively constant rate. During the third stage, moisture which remains embedded within the clothes fabric must first diffuse to the surface to be evaporated. Therefore, the third stage is characterized by slower moisture removal, higher exhaust temperatures and decreasing exhaust dew point.

Figure 7B:
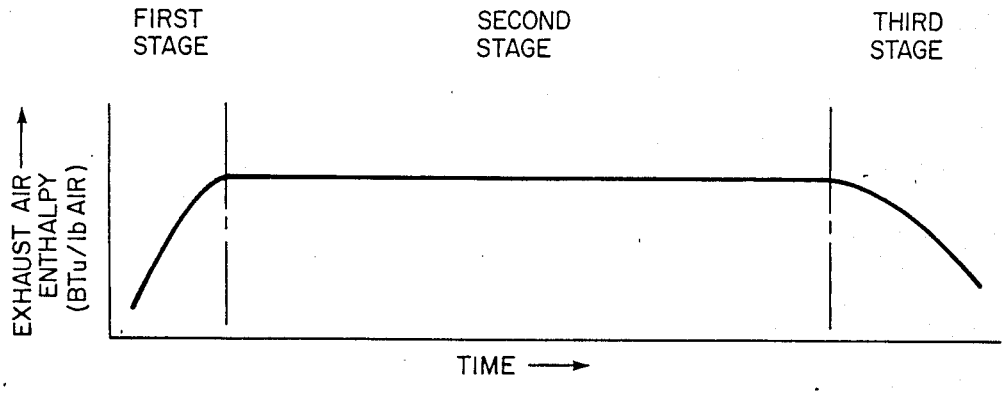
FIG. 7B is a graph of exhaust air enthalpy versus time wherein the time axis is aligned with FIG. 7A.

The graph of FIG. 7B illustrates the total enthalpy of the exhaust air during the three drying stages. As previously discussed, most of the total exhaust enthalpy consists of water vapor enthalpy due to the relatively low exhaust temperatures. Thus, total enthalpy decreases during the third drying stage when exhaust air dew point falls, even though the exhaust air temperature rises.

Since output water temperature is directly related to total enthalpy, maximum water temperatures are obtained only during second stage drying. In a laundromat application, therefore, it may be desirable to couple a thermostatically controlled valve (not shown) to the water outlet. The valve would only allow water to flow through the system when an output water temperature above a predetermined level was detected.

Referring back to FIGS. 2 and 6, the flow of condensation through heat exchanger 110 is now described. Condensation from the exhaust air forms on the upper portion of fins 112 wherein surrounding exhaust air is cooled below dew point. The condensation flows downward along fins 112 onto floor 102 and out through drain outlet 118. Consequently, substantially the entire surface area of fins 112 is covered by downwardly flowing condensate. Corrosive acids are flushed from fins 112 by the downward flowing condensate. These acids, such as hydrochloric acid, carbonic acid and hydrofluoric acid are formed when combustion gases combine with water vapor condensate. Hydrochloric acid, in particular, will corrosively attack most metals suitable for heat transfer surfaces such as copper, aluminum and stainless steel. The flushing which occurs herein is particularly effective since a portion of combustion gases are absorbed by condensate as the gasses flow upwardly over the fins. Consequently, the least acidic condensate forms at the top of fins 112. This substantially neutral condensate is the last to flow over fins 112 thereby washing away the more acidic condensate from the fins and leaving behind a substantially neutral residue.

In addition, since the entire surface area of fins 112 is covered by a film of downward flowing condensate, corrossive attack by highly acidic incipient condensate is substantially eliminated. More specifically, incipient condensation is first formed on portions of fins 112 when exhaust air initially encounters the cool surface areas of fins 112. If fins 112 were not subsequently covered with a film of condensate, the incipient condensation would gradually evaporate thereby becoming more highly concentrated and more corrosive during the drying cycle.

Besides corrosion suppression, the downward flowing condensate will flush away small lint particles which may have passed through lint screen 74. Over time, these small lint particles may otherwise clog fins 112 and impair heat recovery.

Figure 3:
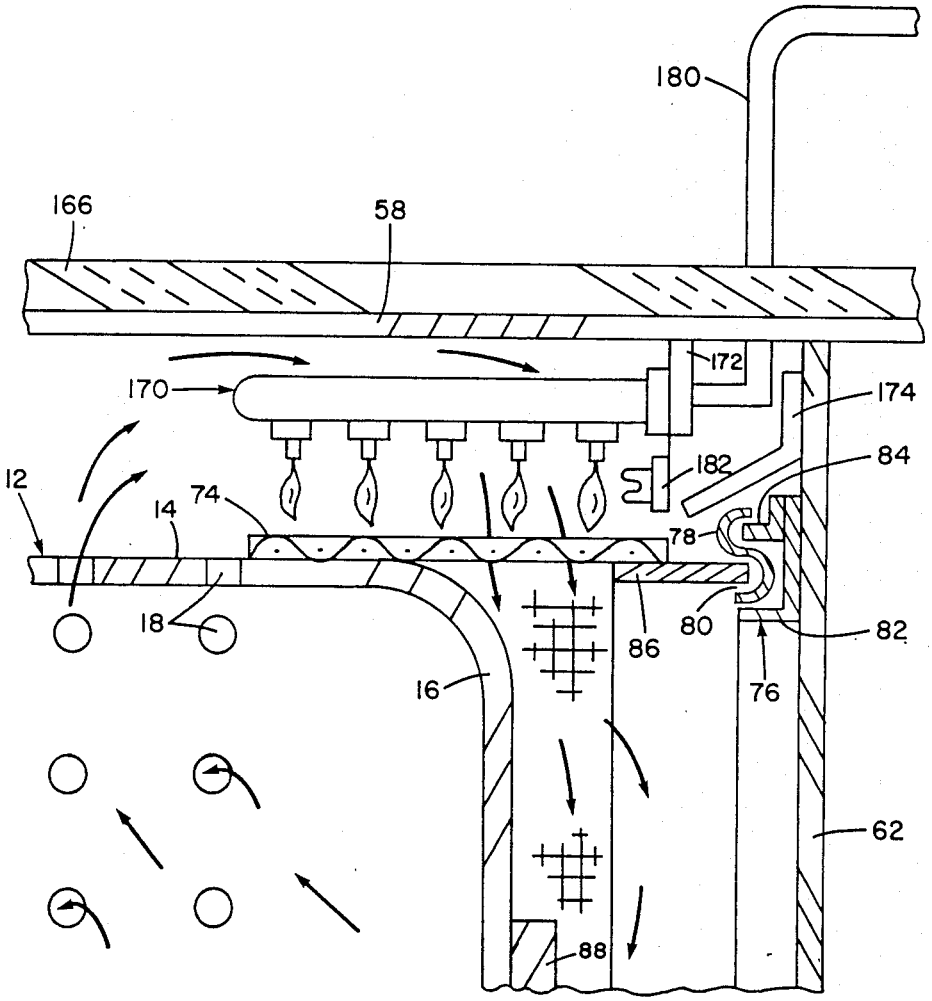
FIG. 3 is an enlarged view of a portion of FIG. 2 taken along line 3—3 of FIG. 2.

The removal and incineration of clothing lint is now described with particular reference to FIGS. 2, 3 and 5. All the air expelled from perforations 18 is radially drawn through rotating lint screen 74 depositing airborne lint thereon. Both airborne lint and lint trapped on screen 74 are prevented from escaping between backwall 62 and screen 74 by seal 76. The entrapped lint is continuously incinerated as screen 74 rotates under the downwardly directed flames of burner 170. Since the circumferential area of screen 74 is relatively large, approximately 20 square feet for a standard 26 inch drum, and the lint is continuously incinerated, the distribution of lint over screen 74 is extremely sparse. Consequently, direct incineration by burner 170 results in total decomposition of the lint. Any ash or carbon residue from the lint will therefore not be perceptible.

The lint burning described hereinabove eliminates the need for manual lint cleaning. Also eliminated is any degradation of dryer performance which would otherwise occur as lint accumulation progressively inhibits air flow. These advantages are particularly important in commercial laundromats where frequent lint cleaning is not practical. Further, the lint incineration does not require additional drive components since screen 74 rotates as drum 12 rotates. In addition, the conventional ducts required for placement of operator accessible filters is avoided. This is another reason for the compactness and minimal thermal mass of dryer 10.

Dryer 10 may also be used to advantage to achieve substantially reduced drying time over conventional dryers without a loss in drying efficiency. For example, by replacing exhaust blower 156 with a 750 cfm blower, dryer 10 will operate with 50% recirculation and a drum air inlet of 1500 cfm. This is approximately twice the drum inlet air flow and the same percentage of recirculation as most conventional dryers. Assuming a 200° F. drum air inlet temperature, second stage drying is then substantially reduced by the high volume of drying air flowing across the clothes.

It is apparent from the foregoing that dryer 12 provides high recirculation without sacrifice to drying efficiency or drying time. The high recirculation results in sufficiently high exhaust enthalpy to heat hot water for end use. High recirculation also provides more evenly heated drum inlet air thereby substantially reducing the possibility of fabric damage to clothing. Dryer 12 may also be adapted to provide substantially reduced drying times, at lower recirculation rates, without sacrifice to drying efficiency.

In addition, a simple compact design is provided without the ducts required to exhaust air, recirculate air and position operator accessible lint filters. Consequently, the low thermal mass decreases warm up time, increases drying efficiency and reduces the dissipation of recoverable exhaust heat.

Continuous lint incineration is also provided thereby eliminating the need for manual lint cleaning. Progressive accumulation of lint during the drying cycle which would impair air flow is also eliminated. The lint incineration is accomplished without the addition of air circulation ducts or drive components.

Although dryer 10 has been described with respect to specific details of certain preferred embodiments, it is not intended or required that such details limit the scope of the invention as set forth in the following claims. It will be apparent that various modifications and changes may be made by those skilled in the art without departing from the spirit of the invention as expressed in the accompanying claims. Hence, all matters shown and described are intended to be interpreted as illustrative and not in a limiting sense.

What is claimed is:

1. A clothes dryer, comprising:

a clothes drum;

a substantially cylindrical lint filter connected to said drum and extending axially from one end thereof;

means coupled to said drum for axially rotating said drum whereby said filter is also rotated;

means for moving air out of said drum and radially through said filter; and stationary burning means for burning lint on said lint filter as said lint filter rotates past said stationary burning means.

2. The dryer recited in claim 1 wherein said cylindrical lint filter comprises a substantially hollow cylinder having a screened circumferential wall.

3. The dryer recited in claim 1 wherein said screened circumferential wall comprises a metal screen.

4. The dryer recited in claim 1 wherein said stationary burning means comprises an electric heating element.

5. The dryer recited in claim 1 wherein said stationary burning means comprises a gas burner.

6. A clothes dryer, comprising:

a clothes drum having a circumferential wall and a backend;

a casing spaced from and surrounding both said drum circumferential wall and said drum backend, said casing having a backwall substantially parallel to said drum backend;

a cylindrical screen connected to said drum and extending axially from said drum backend towards said casing backwall;

an open circular channel connected to said casing backwall and circumferentially aligned with said screen;

a cylindrical extension attached to said screen and extending therefrom into said channel;

means coupled to said drum for axially rotating said drum and said screen;

means for moving air out of said drum and radially through said screen, said air carrying lint from said clothes which is deposited on said screen; and stationary means for burning lint on said screen as said screen rotates past said stationary burning means.

7. The dryer recited in claim 6 wherein said cylindrical extension is comprised of synthetic resin polymer.

8. The dryer recited in claim 6 further comprising a grooved ring inserted into said open circular channel, said cylindrical extension extending into said grooved ring.

9. The dryer recited in claim 8 wherein said grooved ring is comprised of teflon.

10. A clothes dryer, comprising:

a clothes drum defining a substantially cylindrical wall having perforations;

a cylindrical screen connected to said drum and extending axially from an end of said drum;

a motor coupled to said drum for rotating said drum and said screen;

a casing spaced from and surrounding said wall and said screen defining an air duct communicating between said perforations and said screen;

means for moving air through said drum to dry said clothes, said air exiting said drum through said perforations along said air duct and passing radially inward through said screen, said air carrying with it lint from said clothes which is deposited on said screen; and means positioned adjacent to said screen for incinerating said lint as said screen rotates past said incinerating means.

11. The dryer recited in claim 10 wherein said incinerating means comprises an electric heating element.

12. The dryer recited in claim 10 wherein said incinerating means comprises a gas burner.

13. The dryer recited in claim 10 wherein said cylindrical wall is perforated along the entire circumferential surface of said cylindrical wall.

14. A clothes dryer, comprising:

a cylindrical clothes drum having a cylindrical wall and an endwall, said drum also having an air inlet port in said endwall and a plurality of air exit ports in said cylindrical wall;

a cylindrical filter attached to said drum and extending axially from said endwall;

a motor coupled to said drum for rotating said drum and said filter;

an air duct coupled between said exit ports and said filter;

means for moving air through said drum, out said air exit ports, through said duct, radially inwardly through said filter and into said air inlet port, said air carrying lint from said clothes and depositing it on said filter; and means positioned adjacent to said filter for heating said air entering said air inlet port, said heating means also incinerating said lint as said filter rotates past said heating means.

15. The dryer recited in claim 14 wherein said air moving means comprises an axial fan connected to said air inlet port.

16. The dryer recited in claim 14 wherein said filter comprises a hollow cylinder having a meshed circumferential wall.

17. The dryer recited in claim 14 wherein said heating means comprises a gas burner, said burner directing hot gases against said filter.

18. The dryer recited in claim 17 wherein said air comprises a mixture of heated atmospheric air and combustion gases from said burner.

19. A clothes dryer, comprising:

a substantially cylindrical clothes drum having a back end and a circumferential wall with perforations, said drum also having an inlet in said back end;

a casing spaced from and surrounding said drum circumferential wall and said drum back end thereby defining an air recirculation passageway out of said perforations, axially back along said circumferential wall, radially inwardly and back into said drum through said inlet in said back end, said casing also having an ambient air opening coupled to said air passageway;

a cylindrical filter positioned within said casing and connected to said drum, said filter extending axially from said back end into said passageway;

a motor coupled to said drum for rotating said drum and said filter;

a blower coupled to said drum inlet for forcing air to recirculate along said passageway, said air carrying lint from said clothes and depositing it on said filter, said blower also drawing ambient air from said ambient air opening through said filter and into said drum inlet; and a burner positioned adjacent to said filter for heating said ambient air and a portion of the air recirculating through said passageway, said burner also incinerating said lint as said filter rotates past said burner.

20. The dryer recited in claim 19 further comprising means coupled to said passageway for exhausting a part of said air recirculating through said passageway after it has passed through said filter.

21. The dryer recited in claim 19 whrerin said blower comprises an axial fan connected to said drum inlet.

22. A clothes dryer, comprising:

a substantially cylindrical clothes drum having an endwall and a circumferential wall with perforations, said drum also having an air inlet in said endwall;

a housing spatially separated from and encapsulating both said drum endwall and said drum circumferential wall;

an exhaust outlet connected to said housing opposite said drum endwall;

a cylindrical filter attached to said drum, said filter extending axially from said endwall to said housing thereby encircling said exhaust outlet;

a motor connected to said drum for rotating said drum and said filter;

an air passageway defined by the spacing between said housing and both said circumferential wall and said endwall;

a fan coupled to said drum air inlet for forcing air into said drum and expelling said air through said perforations, said fan drawing said expelled air from said perforations back through said air passageway and radially inward through said filter, said expelled air carrying lint from said clothes which is entrapped in said filter, said fan also drawing a portion of said expelled air into said drum air inlet after said expelled air has passed through said filter;

means for drawing the remaining portion of said expelled air through said exhaust outlet after said expelled air has passed through said filter; and a burner positioned adjacent to said filter for heating air entering said drum air inlet, said burner also incinerating said lint as said filter rotates past said burner.

23. The dryer recited in claim 22 further comprising an ambient air inlet coupled to said housing.

24. The dryer recited in claim 23 wherein said fan also draws ambient air from said ambient air inlet across said burner, through said filter and into said drum air inlet.

25. The dryer recited in claim 22 wherein said cylindrical filter comprises an open cylinder defined by a meshed circumferential wall.

26. The dryer recited in claim 22 wherein said drawing means comprises a blower coupled to said exhaust outlet.

27. A clothes dryer, comprising:

a clothes drum;

a lint filter affixed to said drum;

means for rotating said drum and said lint filter affixed thereto;

means for moving air out of said drum and through said lint filter; and burning means for burning lint on said lint filter as said lint filter rotates past said burning means.

28. A clothes dryer, comprising:

a clothes drum comprising a substantially circumferential wall and an end, said wall having an air exit port;

an air passageway comprising portions of said circumferential wall and said end, said air passageway communicating with said air exit port;

a lint filter affixed to said drum and positioned in said air passageway;

means for rotating said drum and said lint filter about the axis of said drum;

means for moving air out of said air exit port and through said lint filter in said air passageway; and burning means communicating with said air passageway for burning lint on said lint filter as said lint filter rotates past said burning means.

* * * * *